US005279189A

United States Patent [19]

Marino

[11] Patent Number: 5,279,189

[45] Date of Patent: Jan. 18, 1994

[54] TOOL FOR THE APPLICATION OF THREADED FASTENERS

[76] Inventor: Frank Marino, 9 Hazeltine Rd., Upton, Mass. 01568

[21] Appl. No.: 11,772

[22] Filed: Feb. 1, 1993

[51] Int. Cl.[5] ..... B25B 13/06; B25G 1/00

[52] U.S. Cl. ..... 81/177.8; 81/177.2; 81/177.6; 81/177.7

[58] Field of Search ..... 81/177.1, 177.8, 177.9, 81/177.2, 177.6, 177.7, 489, 28, 35, 37

[56] References Cited

U.S. PATENT DOCUMENTS 884,856 4/1908 Requillart ..... 81/35
1,431,389 10/1922 Frisz ..... 81/177.7
1,810,006 6/1931 Edwards ..... 81/177.6 X
1,835,315 12/1931 McLay ..... 81/177.6 X
1,975,695 10/1934 Lund ..... 81/177.75
3,383,962 5/1968 Harris ..... 81/177.9
4,334,445 6/1982 Timewell ..... 81/177.8 X

*Primary Examiner*—D. S. Meislin

[57] ABSTRACT

A tool for attachment and removal of threaded components including a coupling adapted to engage the component and an arm having a first handle and a second handle displaced longitudinally by a given distance and including at least one hinge connecting the coupling to the arm or connecting the first handle to the second handle and permitting relative movement therebetween about a pivot axis substantially normal to a plane retaining the rotational axis of the coupling.

7 Claims, 18 Drawing Sheets

TOOL FOR THE APPLICATION OF THREADED FASTENERS

FIELD OF THE INVENTION

This invention deals with an improvement to a tool, in particular to that type of tool used to manually attach or remove threaded fasteners, or the like.

BACKGROUND OF THE INVENTION AND DESCRIPTION OF RELATED ART

It is common in the attachment of such threaded fasteners that the fastener must first be fitted to a structure with mating thread, then rotated without substantial torque until the fastener and structure are substantially, but not fully attached, then further rotated with a much higher degree of torque until the fastener is fully attached to the structure. A reversal of this procedure would be followed for removal of such a fastener from such a structure.

For example, to attach a hexagonally shaped nut with single pitch threading to a mating threaded post of a certain length which projects above a surface, one would first fit the nut over the post so as to engage the threads, then one would rotate the nut one turn for each thread of the post until the nut comes to contact the surface, then one would use a hexagonal wrench to further rotate the nut until a sufficient degree of locking pressure has been obtained between the nut and the surface. Depending on the number of threads of the post, and the fit of the mating threads, it is often preferred to use a tool adapted for fast rotation of those turns not requiring the high torque of the wrench.

There are a number of existing tools so adapted, including the tool depicted in FIG. 16 which is adapted for high speed rotation of a fastener, but the torque available from such a tool is insufficient to fully engage the fastener, or to disengage a fastener which had been fully engaged. Use of this tool, therefore, is only beneficial for the high speed/low torque rotations of the fastener, and one must still use the wrench to provide the high torque final rotations.

There are a number of other existing tools which are intended to have both of the properties of high speed/low torque and low speed/high torque application, but those are either complicated and expensive to produce, such as those that use switchable gearing, or are adapted to compromise both functions to provide service somewhat less than desired in each case, such as the tool depicted in FIG. 17 which cannot provide the torque of a standard wrench or the speed of a speed handle.

One existing tool which can serve both functions of high torque/low speed and high speed/low torque is depicted in FIG. 18 and is comprised of two long perpendicular bars permanently attached at their midpoints. One of the bars which is coaxial with the fitting is intended to provide a rotational support during high speed rotation, and the other bar is intended to provide a means for applying force during high torque application. The most notable disadvantage to this tool is its size and shape which render it cumbersome and expensive to inventory, ship, and store.

In U.S. Pat. No. 4,334,445, timewell discloses a tool which includes a fitting and a single handle, connected to an intermediary member by two hinges. This tool is claimed to be adaptable into positions which allow both high torque operation, and high speed operation. However, this invention lacks a means to support the tool with hands at two separate locations, rendering the tool difficult and awkward to operate during some applications in the high speed condition, for instance those applications where the fitting cannot firmly engage the fastener such as the way a slotted screwdriver engages a slotted screw. Also, due to the amorphous relationship between the fitting and the handle of this tool caused by the use and location of the two hinges, it is not practical to use this tool in the high speed condition for applications where, in addition to the usual tangential force, the fitting must engaged the fastener with also an axial force, such as the way a screwdriver engages a mating screw.

SUMMARY OF THE INVENTION

The object of the present invention is to avoid the foregoing disadvantages while incorporating into one individual device the most desirable features of a tool for the attachment and removal of threaded fasteners. The present invention can serve both required functions of a tool to be used for the manual attachment or removal of threaded fasteners, namely the high torque/low speed and the low torque/high speed functions, without compromising the performance of the tool in regards to either function, by being quickly and simply converted from one condition to a differing condition through the performance of only one action, and requiring no additional components. The present invention can also be configured for efficient storage, requiring no more storage space than any of the most basic tools of prior art which perform only one function.

DESCRIPTION OF THE DRAWINGS

Several conceived embodiments of the invention are depicted in the accompanying drawings.

DESCRIPTION OF THE PREFERRED EMBODIMENTS

Figure 1:
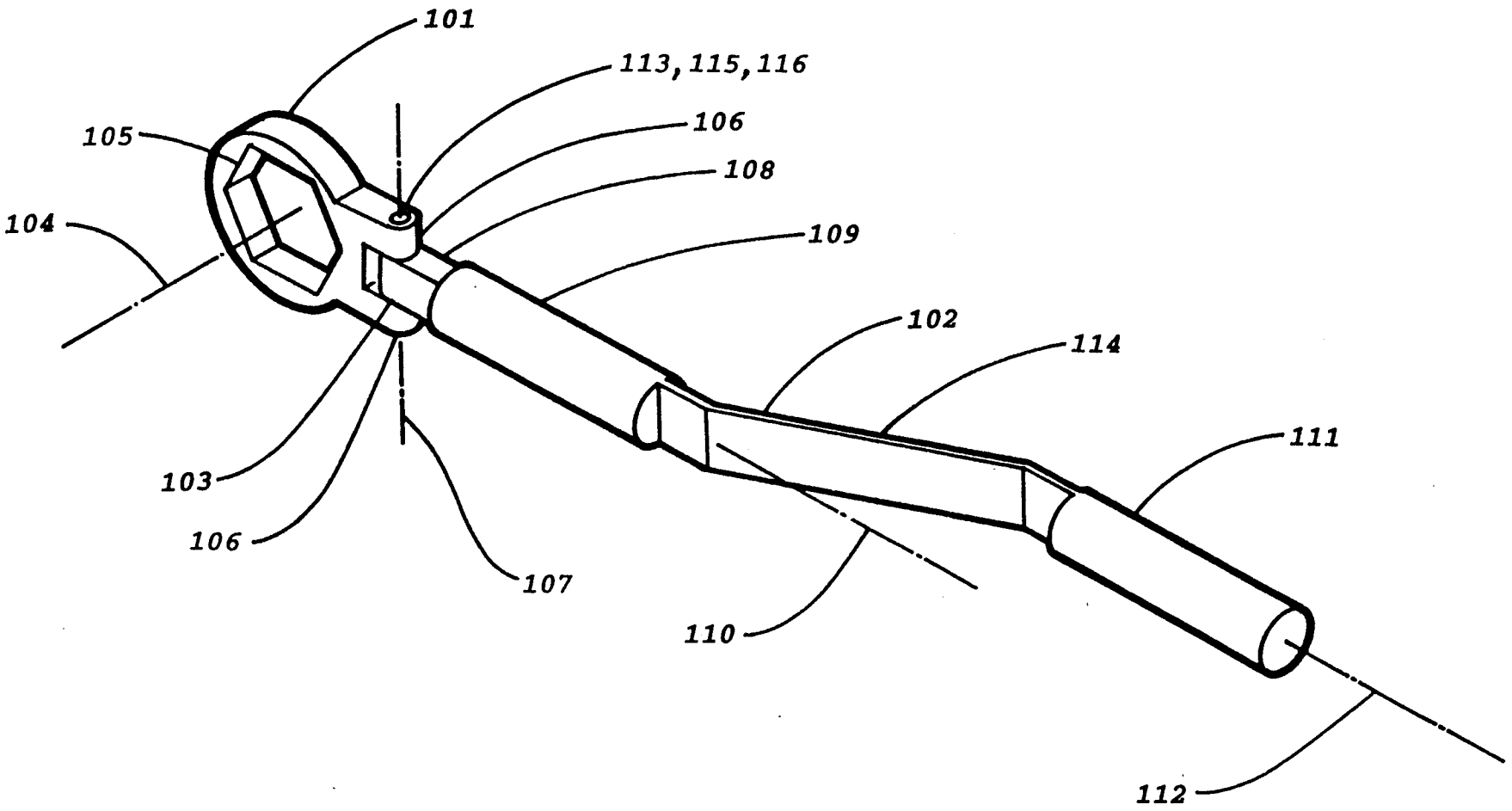
FIG. 1 is a perspective view of a the first embodiment of the invention in a configuration adapted for low speed/high torque application.

A first embodiment of the invention is depicted in FIGS. 1, 2, 3, & 4. It consists of a fitting (101) and an arm (102) connected at a hinge (103). The fitting (101), commonly known as a box wrench, includes an internal hexagonally shaped feature (105) to engage the mating external hexagon of a nut or bolt head (not shown). The feature (105) has a longitudinal centerline (104), and two extensions (106) which each include a hole (115) sharing a common axis (107). Said axis (107) is perpendicular to the centerline (104) of the feature (105) to form a portion of the hinge (103). The axis (107) is separated from the centerline (104) by a certain first distance. The arm (102) includes a single extension (108) which freely fits within the extensions (106) of the fitting (101) and includes a hole (116) which is aligned coaxially with the holes (115) of the extensions (106) of the fitting (101). Adequate clearance is provided between the extensions (106) of the fitting (101) and the extension (108) of the arm (102) to allow pivoting of the arm (102) about the hinge (103) from at least the position depicted in FIG. 1 to the position depicted in FIG. 2. A cylindrical pin (113) is inserted through said three coaxial holes (115 & 116) to comprise the hinge (103). The arm (102) further includes a first cylindrical handle (109) adjacent to the single extension (108). The centerline (110) of said first handle (109) being perpendicular to and coplanar with the axis (107) of the hinge (103), and coplanar with the centerline (104) of the internal hexagon feature (105). The arm (102) further includes a second cylindrical handle (111) more distant from the hinge (103) than the first handle (109). The centerline (112) of said second handle (111) being parallel to the centerline (112) of the first handle (109) and coplanar with the centerline (104) of the internal hexagon feature (105). The distance between the centerline (110) of the first handle (109) and the centerline (112) of the second handle (111) is equal to said certain first distance. The arm portion further includes a rigid connecting portion (114) between the first (109) and second (111) handles.

The hinge (103) is adapted to allow ninety angular degrees of pivot of the arm (102) so as to allow at least two conditions of operation. The first condition, depicted in FIGS. 1, 3, & 4, is such that the centerlines (110) of the first handle (109) and the centerline (112) of the second handle (111) are perpendicular to the centerline (104) of the internal hexagon feature (105), and the second condition, depicted in FIG. 2, and depicted in phantom line in FIG. 3, is such that said handle centerlines (110 & 112) are parallel to said feature centerline (104). The dimensional relationship of the feature (105), hinge (103), first handle (109), and second handle (111) is thereby such that in the condition depicted in FIG. 2, and depicted in phantom line in FIG. 3, the centerline (112) of the second handle (111) is aligned with the centerline (104) of the feature (105).

In the condition depicted in FIGS. 1, 3, & 4, the tool is thereby adapted to provide a high mechanical advantage between a tangential force applied to the second handle (111) about the centerline (104) of the feature (105), and the torque resulting at said feature (105). This is the condition herein referred to as the high torque condition.

Figure 2:
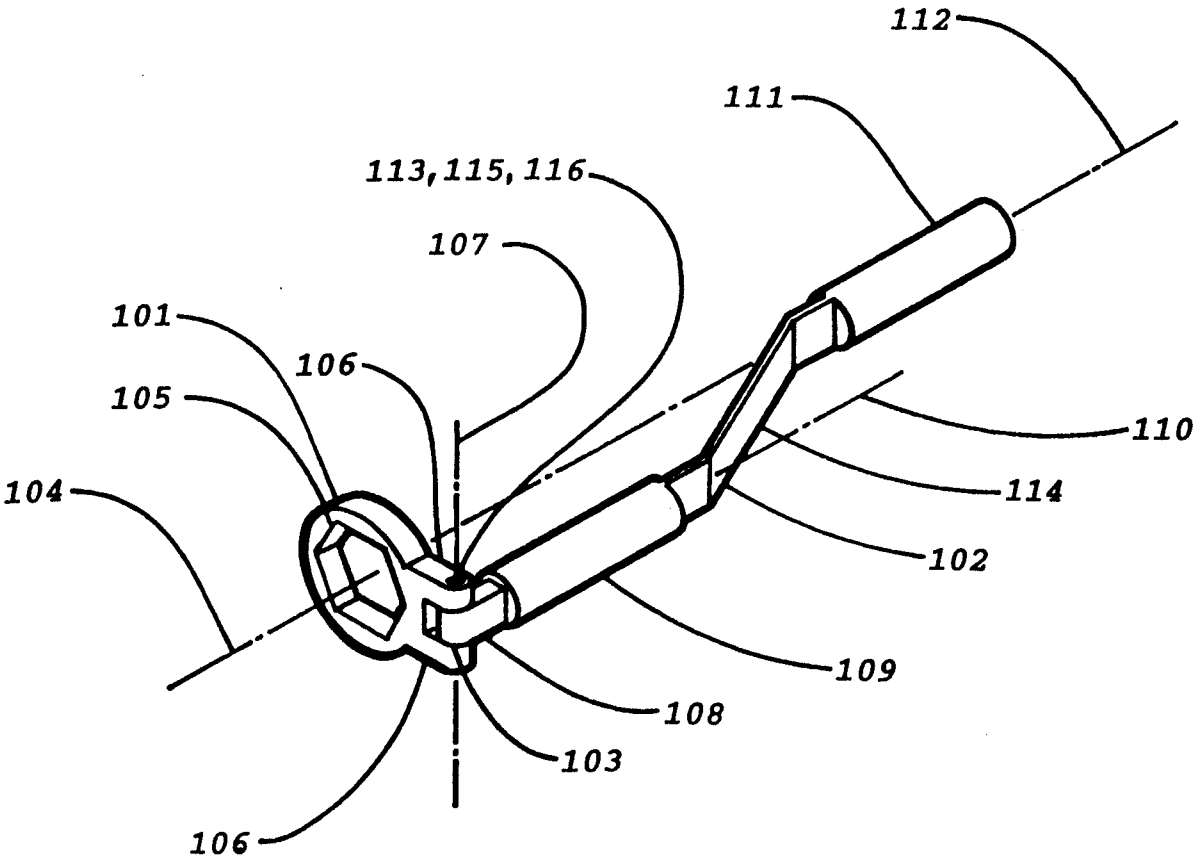
FIG. 2 is a perspective view of the tool shown in FIG. 1 in an alternate configuration adapted for high speed/low torque application.
Figure 3:
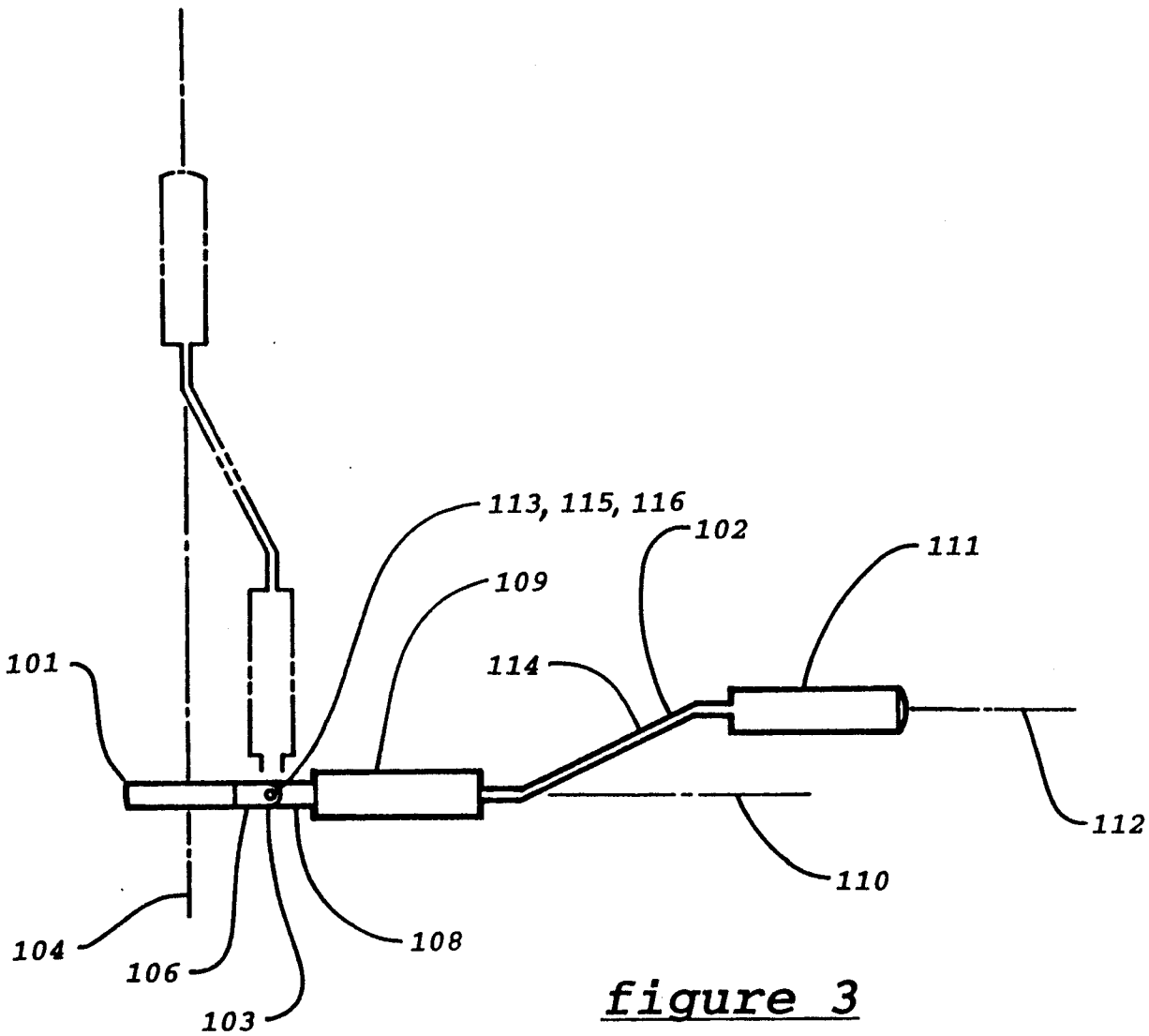
FIG. 3 is an elevational view of the tool shown in FIG. 1 in which the arm portion is shown also in phantom lines configured as depicted in FIG. 2.
Figure 4:
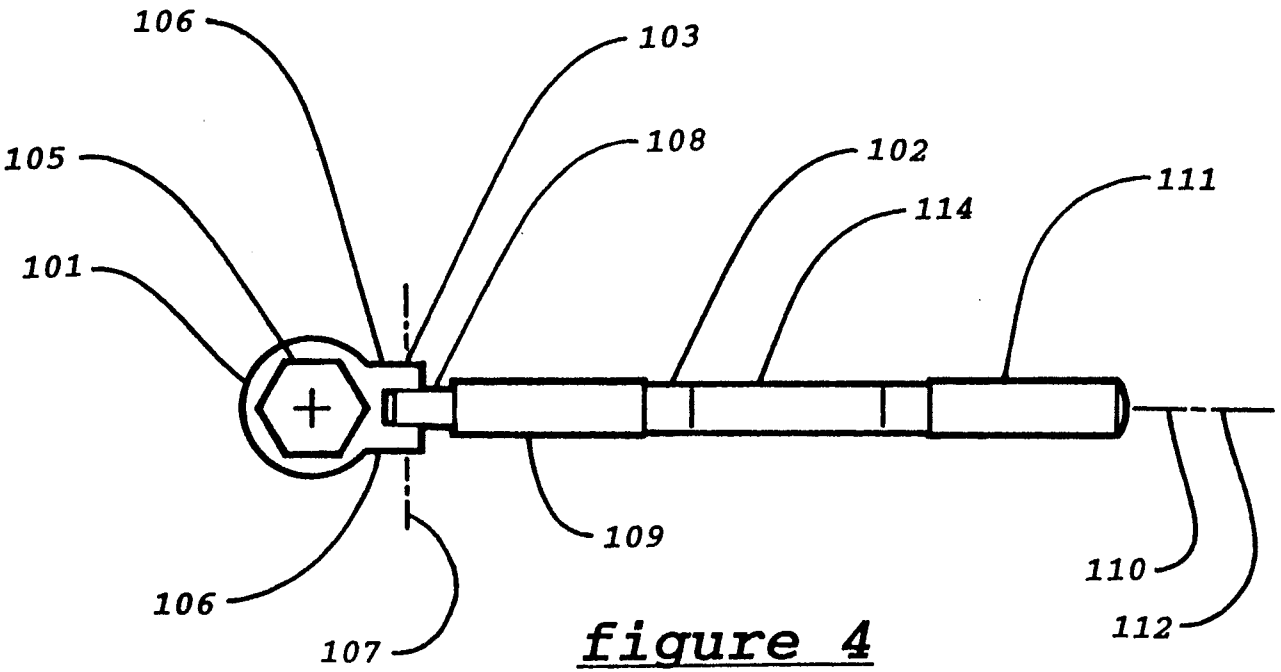
FIG. 4 is a bottom view of the tool shown in FIG. 1.

In the condition depicted in FIG. 2, and depicted in phantom line in FIG. 3, the tool is thereby adapted to provide a high speed rotation of the hexagon feature (105) by application of a tangential force to the first handle (109), about the common axis which is thereby established by the alignment of the center line (104) of the feature (105) and the centerline (112) of the second handle (111).

Figure 5:
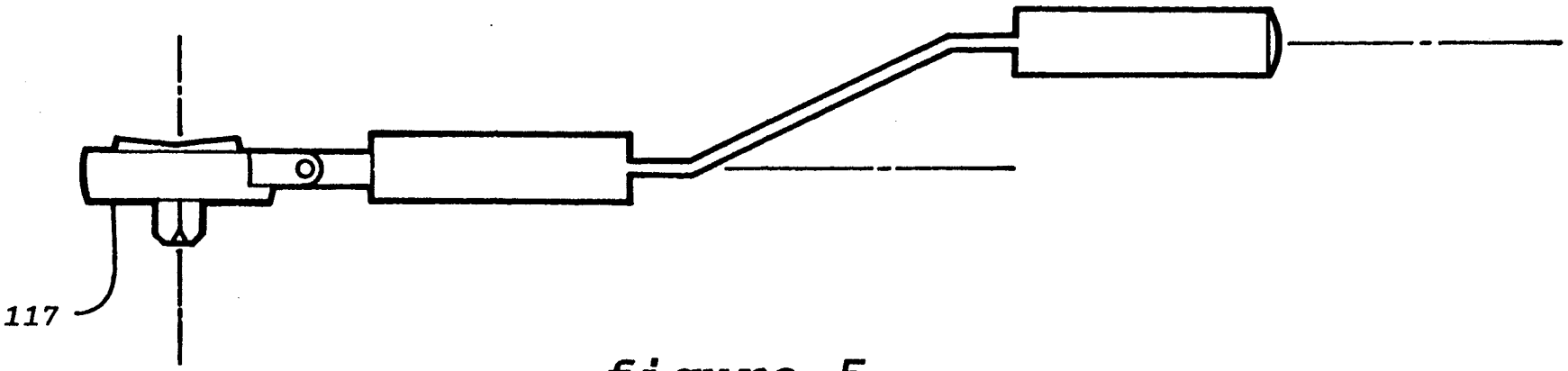
FIG. 5 is an elevational view of a slight variation of the first embodiment of FIG. 1 in which the fitting is instead a common ratchet head adapted for quick exchange of variously sized common sockets.
Figure 6:
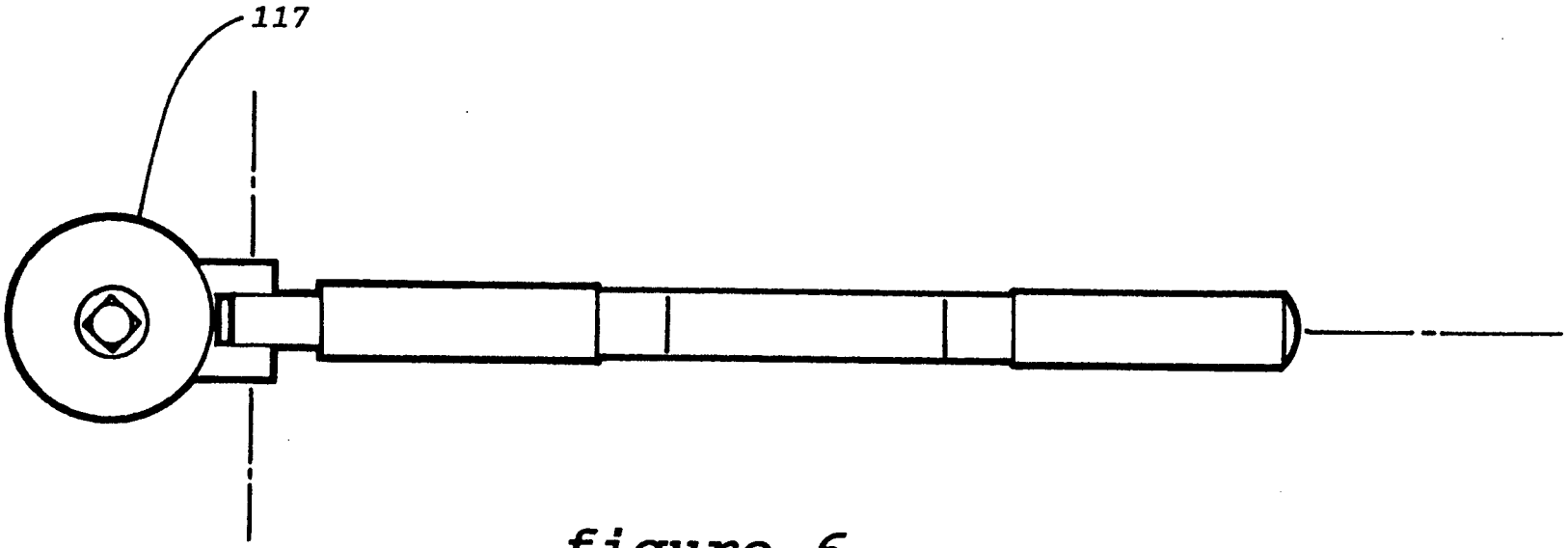
FIG. 6 is a bottom view of the tool shown in FIG. 5.

A slight variation of the first embodiment is depicted in FIGS. 5 & 6 where the fitting (101) of the first embodiment has been replaced by a common ratchet head (117) for accepting common sockets (not shown).

Figure 7:
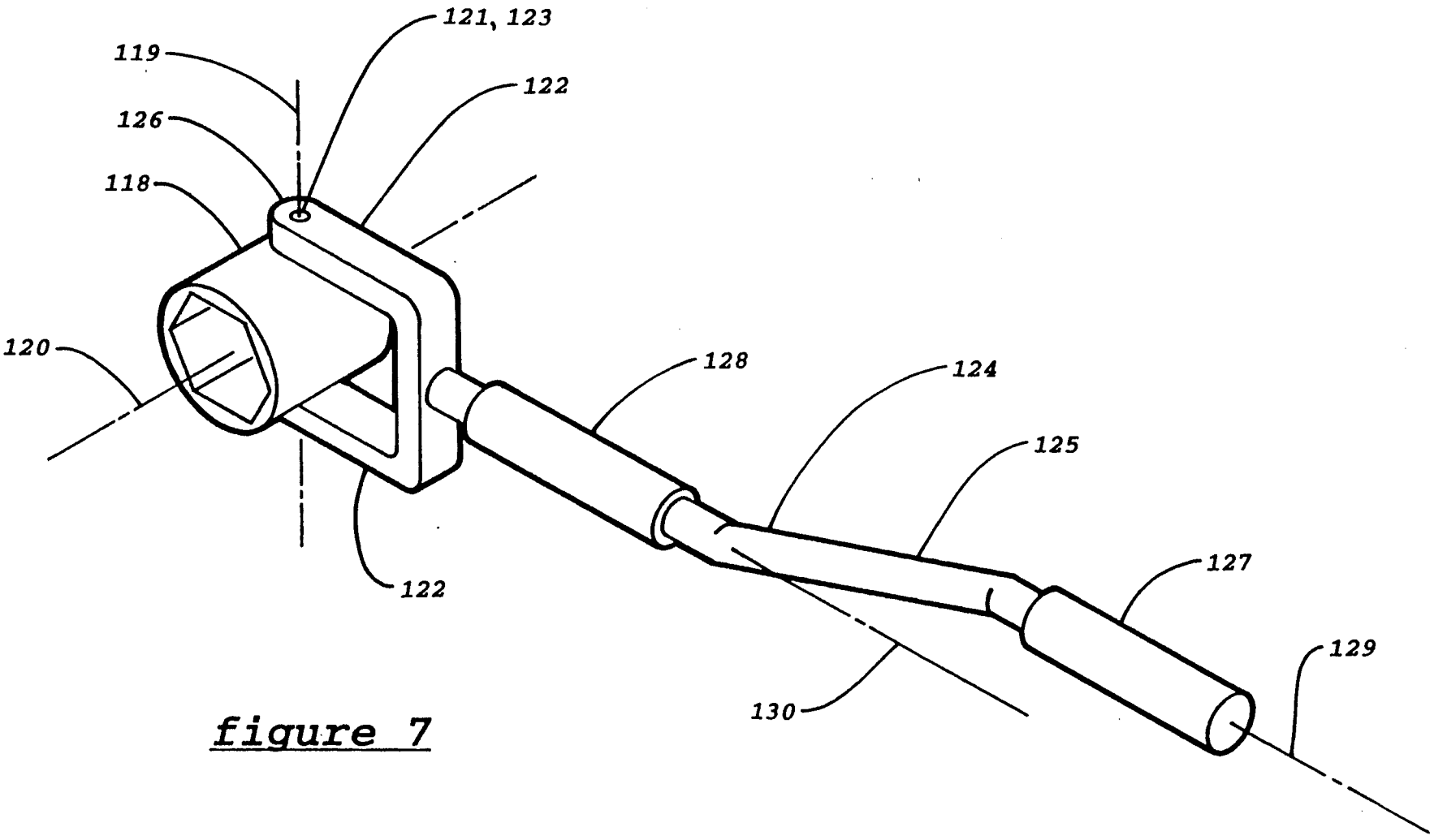
FIG. 7 is a perspective view of the second embodiment of the invention in a configuration adapted for low speed/high torque application.
Figure 8:
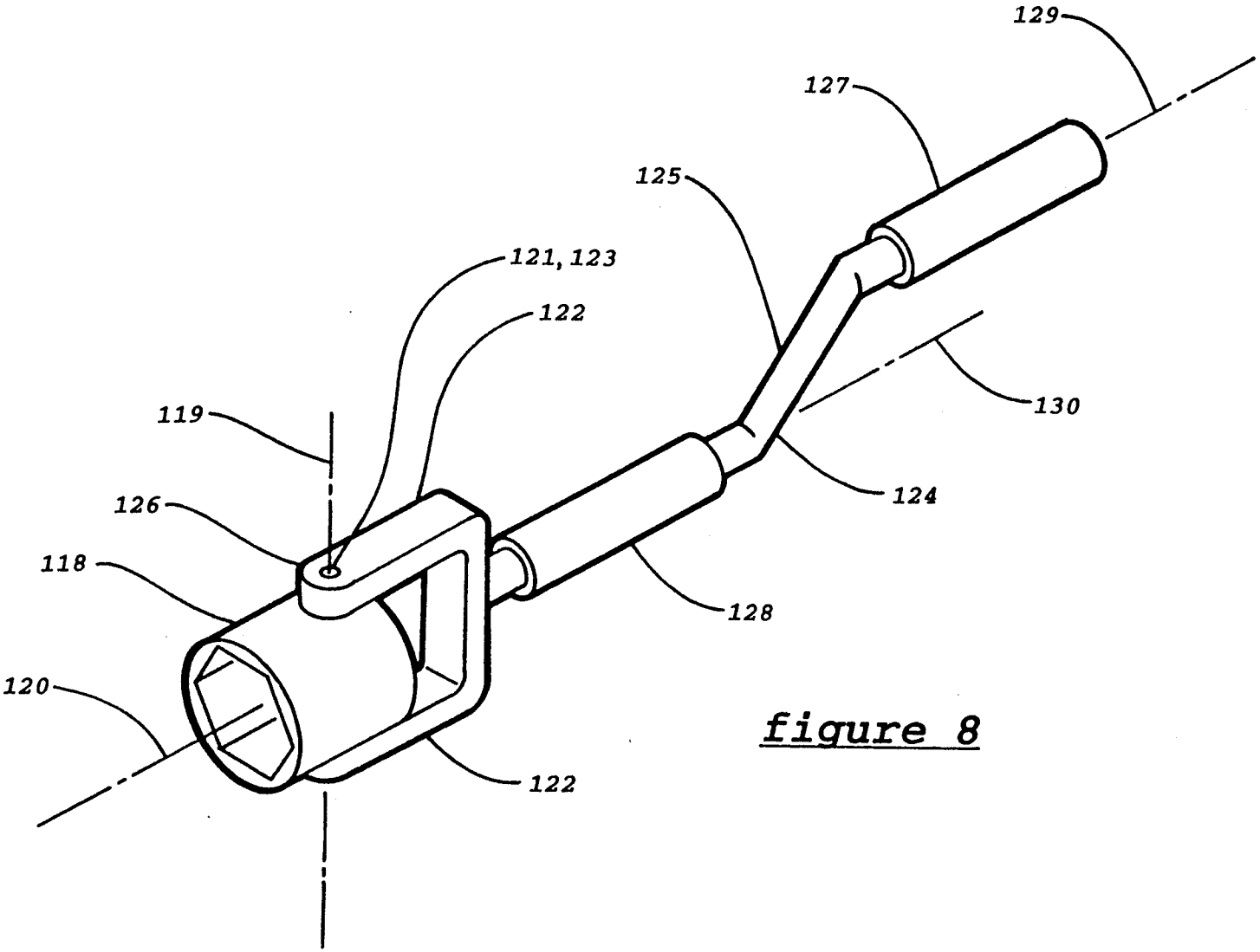
FIG. 8 is a perspective view of the tool shown in FIG. 7 in an alternate configuration adapted for high speed/low torque application.

A second embodiment of the invention is depicted in FIGS. 7 & 8. The arm portion (124) includes two extensions (122) to form a portion of the hinge (126). Two cylindrical pins (121) are each inserted through holes (123) on each extension (122) and on each side of the fitting (118) to complete the hinge (126). The axis (119) of the hinge (126) is coplanar and perpendicular to the axis (120) of the fitting (118) and also coplanar and perpendicular to the centerline (130) of the first handle (128). Adequate clearance is provided between said two extensions (122) and said fitting (118) to allow pivoting of the arm portion (124) about the hinge (126) from the configuration depicted in FIG. 7 to the configuration depicted in FIG. 8. The centerline (129) of the second handle (127) is parallel to said centerline (130) of said first handle (128) and separated by a certain second distance. The handles (127 & 128) are made unitary through the connecting portion (125) of the arm portion (124).

During use in the configuration depicted in FIG. 7, the first (128) and second (127) handles are oriented perpendicularly to the axis (120) of the fitting (118) so as to provide the mechanical advantage required for high torque about said axis (120) by application of a tangential force to the second handle (127) about said axis (120).

During use in the configuration depicted in FIG. 8, the first handle (128) is coaxial with the fitting (118), so as to provide a rotational support for the tool, and the second handle (127) is parallel to the axis (120) of the fitting (118) and separated by said certain second distance, so as to provide a mechanism by which the tool can be quickly rotated about said axis (120).

Figure 9:
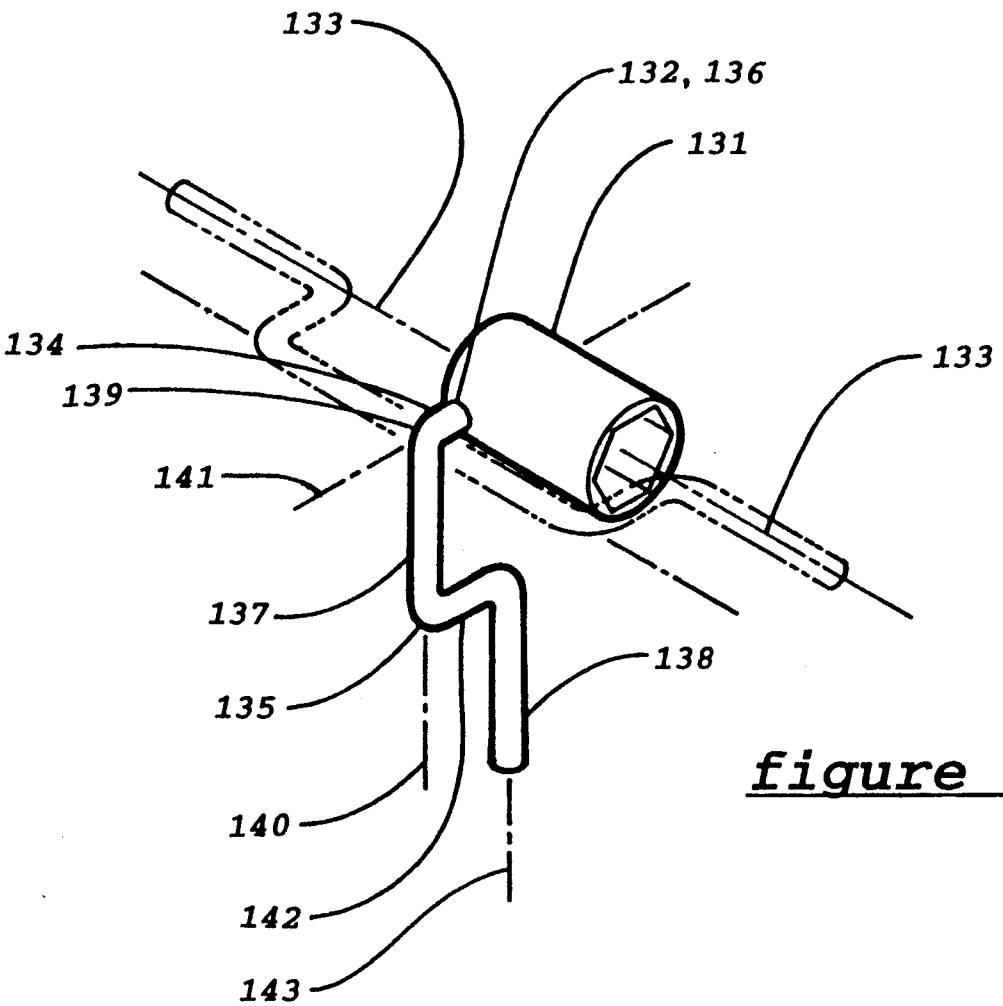
FIG. 9 is a perspective view of the third embodiment of the invention in a configuration adapted for low speed/high torque application with two other configurations, namely the high speed/low torque configuration and a storage configuration, shown in phantom lines.

A third embodiment of the invention is depicted in FIG. 9. The drawing shows the tool in the configuration adapted for high torque application of a fastener (not shown), with phantom lines showing the high speed configuration and the storage configuration. In this embodiment, the holes (132) of the fitting (131) which form the portion of the hinge (136) extend fully through the fitting (131) without obstruction such that the axis (141) of said hinge (136) is perpendicular to and coplanar with the axis (133) of the fitting (131). The arm portion (135) includes three functional portions, the cylindrical pin (134) of the hinge portion (136), the first handle portion (137), and the second handle portion (138). Said cylindrical pin (134) is of length and diameter sufficient to freely engage both holes (132) of the hinge portion (136) of the fitting (131), and is attached at one end (139) to said first handle (137) whose centerline (140) is perpendicular to the axis (141) of said hinge (136), and separated from the axis (133) of the fitting (131) by a certain third distance. Said first handle (137) is of length sufficient to allow the grasp of a human hand (not shown). Said second handle (138) is more distant from the hinge (136) than the first handle (137), and is attached to said first handle (137) by a connecting portion (142). The centerline (143) of said second handle (138) is parallel to the centerline (140) of said first handle (137) and separated from said centerline (140) of said first handle (137) by said certain third distance so as to be coplanar with the axis (133) of the fitting (131).

During the depicted configuration, the centerline (143) of the second handle (138) is perpendicular to the axis (133) of the fitting (131) and adapted to provide the mechanical advantage required for high torque about the axis (133) of the fitting (131) by application of a tangential force to the second handle (138) about said axis (133).

The dimensional relationship between the arm (135) and the fitting (131) allow rotation of the arm (135) about the axis (141) of the hinge (136) to at least those two configurations depicted in phantom line, one of said two configurations being the high speed configuration, and the other being a storage configuration.

During use in the high speed configuration, the second handle (138) is coaxial with the fitting (131), so as to provide a rotational support for the tool. The first handle (137) is parallel to the axis (133) of the fitting (131) and the centerline (140) of said first handle (137) is separated from the axis (133) of the fitting (131) by said certain third distance, so as to provide a mechanism by which the tool can be quickly rotated about said axis (133).

With the arm (135) rotated about the hinge (136) one hundred and eighty angular degrees from the high speed configuration, a storage configuration is thereby established in which the tool's total length is minimized to provide a shape more compact for reduced volume during storage.

The arm portion (135) of this embodiment could be developed from a continuous length of cylindrical material in such a way that the cylindrical pin (134) of the hinge (136) and each of said first (137) and second (138) handles can be thereby formed from said continuous length of material, such as a length of cylindrical steel rod.

Figure 10:
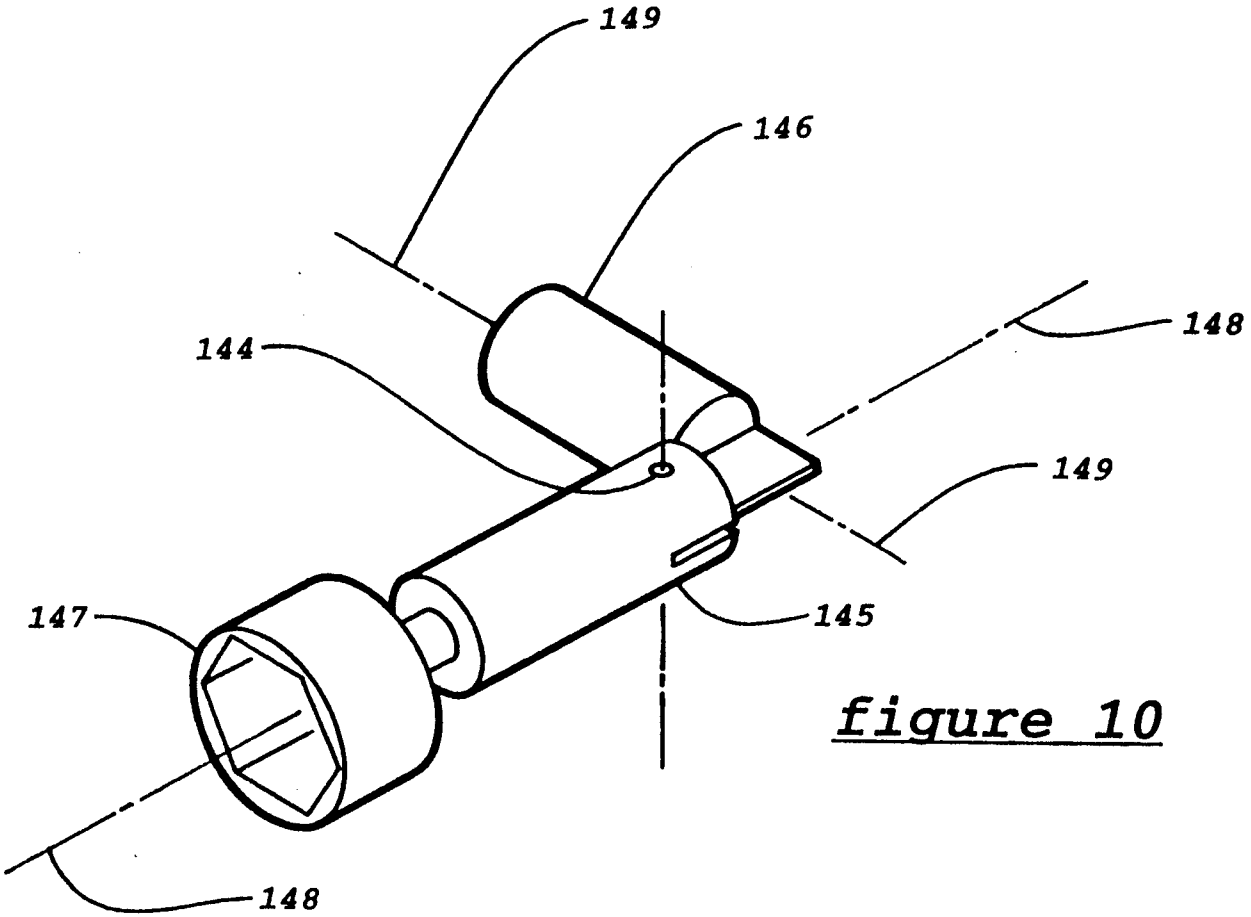
FIG. 10 is a perspective view of the fourth embodiment of the invention in a configuration adapted for low speed/high torque application.
Figure 11:
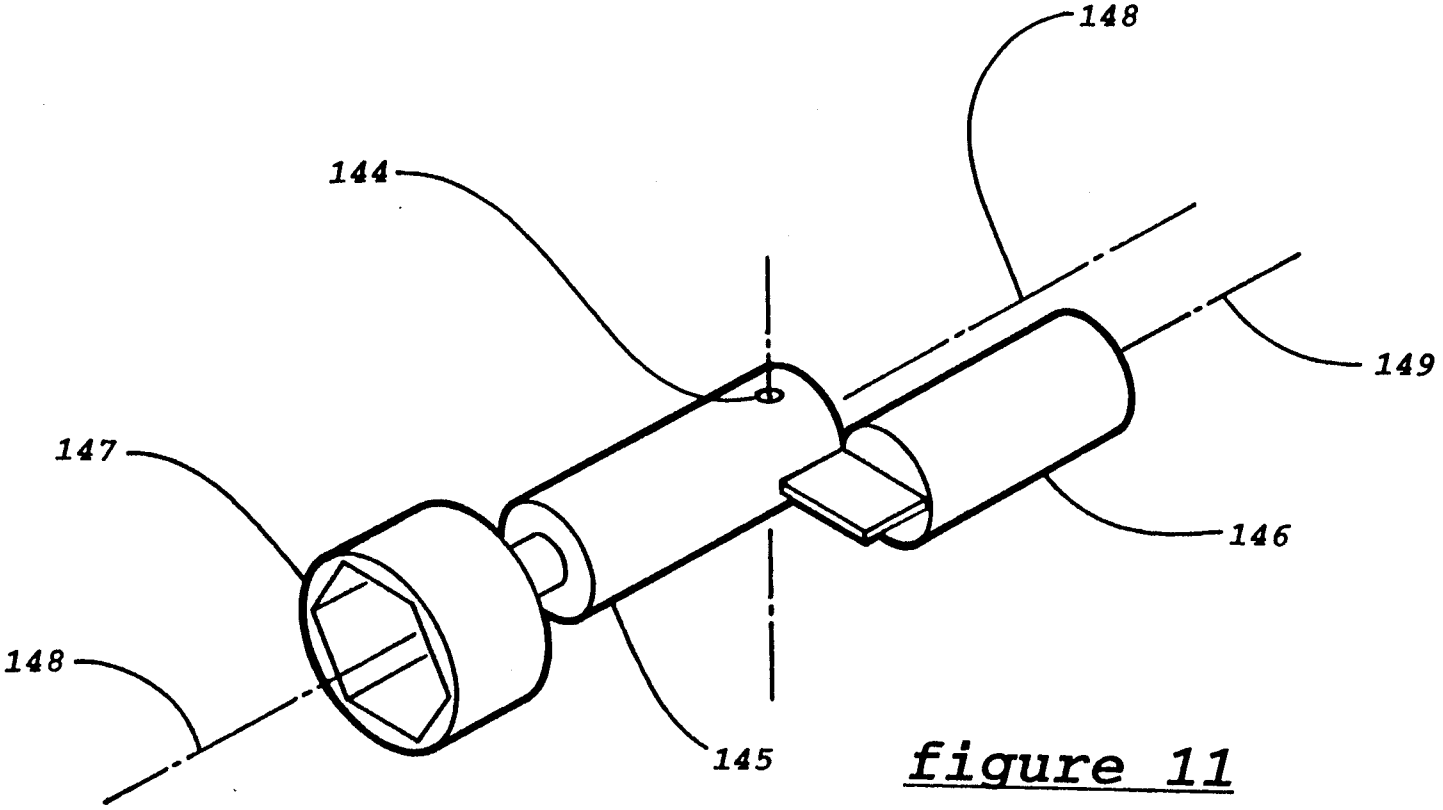
FIG. 11 is a perspective view of the tool shown in FIG. 10 in an alternate configuration adapted for high speed/low torque application.
Figure 12:
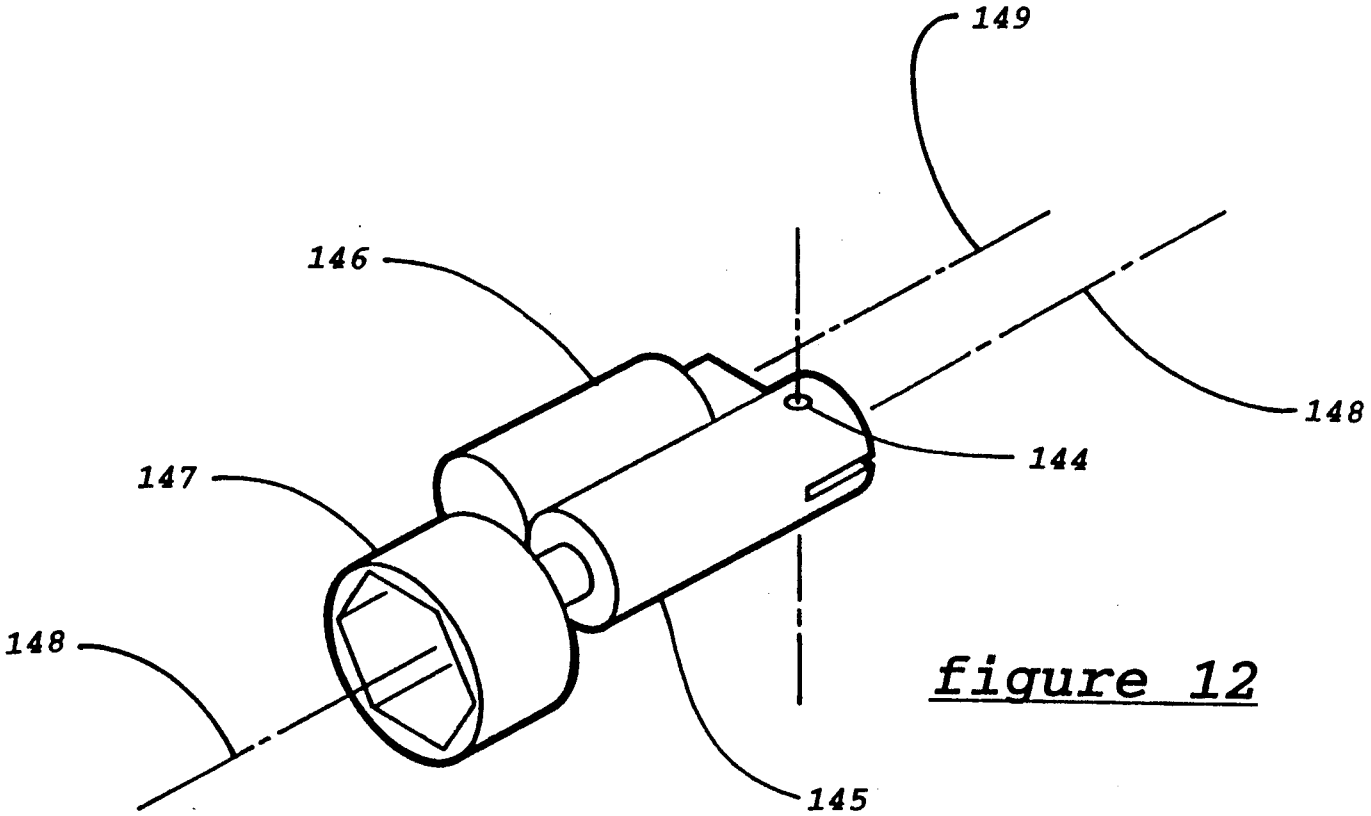
FIG. 12 is a perspective view of the tool shown in FIG. 10 in an alternate configuration adapted for storage.

FIGS. 10, 11, & 12 depict a fourth embodiment wherein the hinge (144) is located between the first (145) and second (146) handles, the first handle (145) thereby being unitary and coaxial with the fitting (147). The second handle (146) is adapted to pivot about the hinge (144) relative to the first handle (145) and the fitting (147).

During use in the configuration depicted in FIG. 10, the second handle (146) is oriented perpendicularly to the axis (148) of the fitting (147) so as to provide the mechanical advantage required for high torque about said axis (148) by application of a tangential force to the second handle (146) about said axis (148).

During use in the configuration depicted in FIG. 11, with the first handle (145) being a rotational support for the tool, the second handle (146) is positioned about the hinge (144) so that the centerline (140) of said second handle (146) is parallel with the axis (148) of the fitting (147), and separated by a certain fourth distance which is at least equal to the average width of the two handles (145 & 146), so that said second handle (146) can provide a mechanism by which the tool can be quickly rotated about said axis (148).

In FIG. 12, with the second handle (146) rotated about the hinge (144) one hundred and eighty angular degrees from the configuration of FIG. 11, a storage configuration is thereby established in which the tool's total length is minimized to provide a shape more compact for reduced volume during storage.

Figure 13:
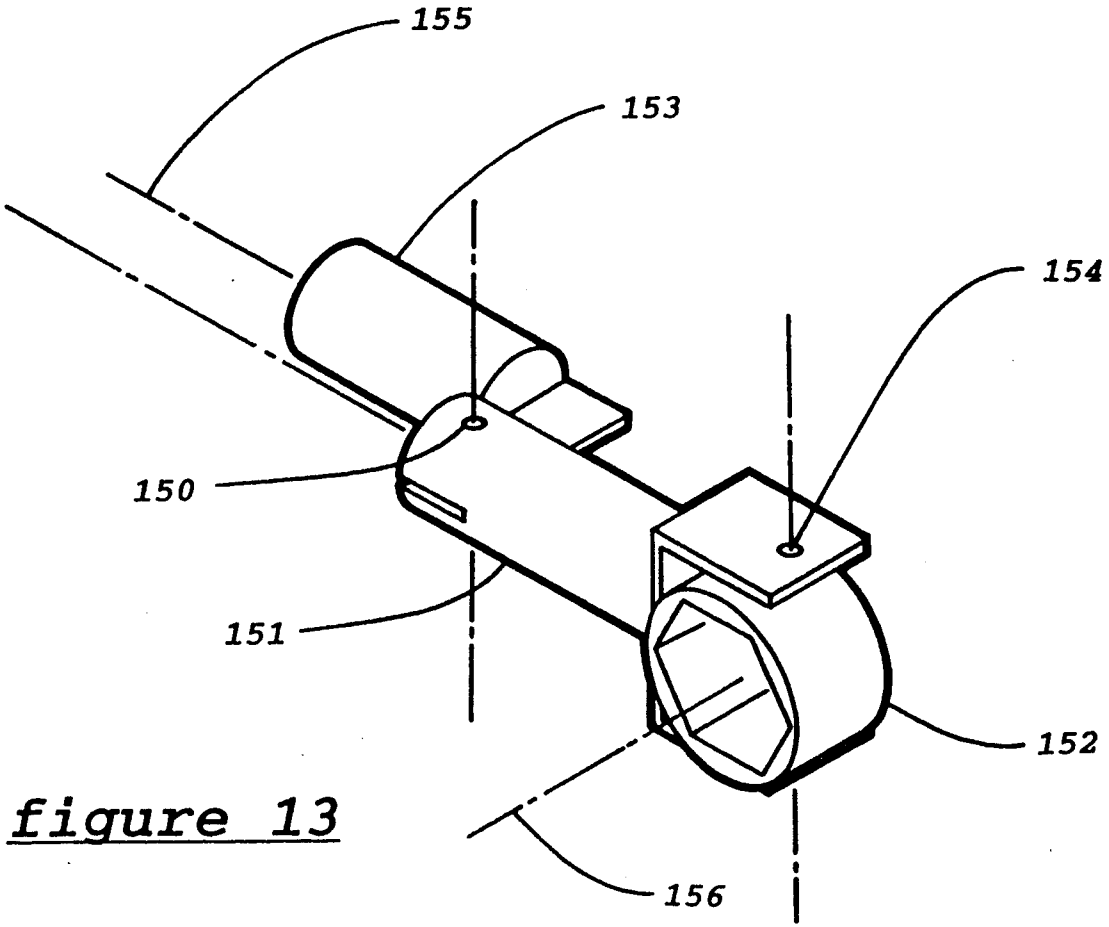
FIG. 13 is a perspective view of the fifth embodiment of the invention in a configuration adapted for low speed/high torque application.
Figure 14:
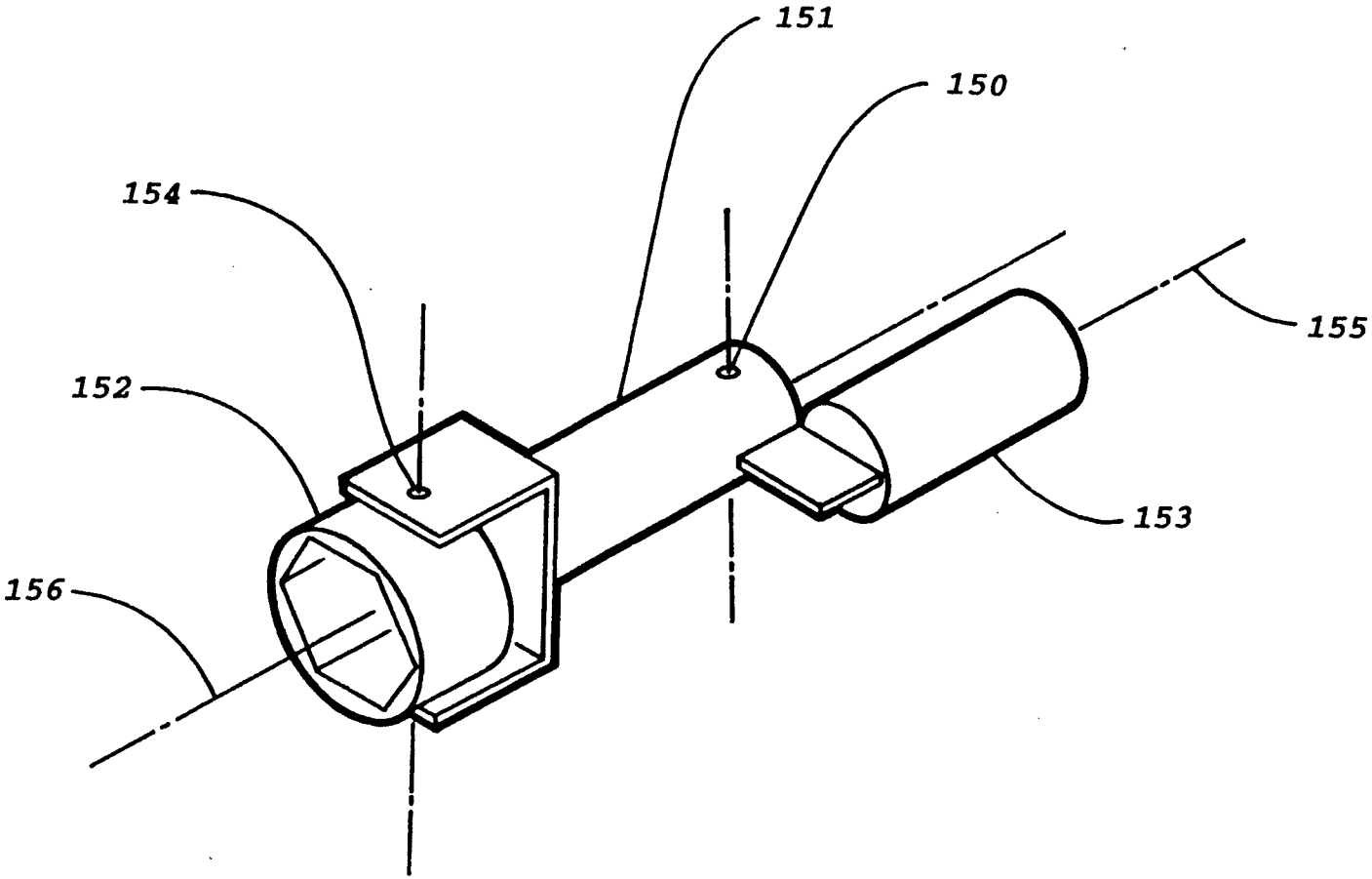
FIG. 14 is a perspective view of the tool shown in FIG. 13 in an alternate configuration adapted for high speed/low torque application.
Figure 15:
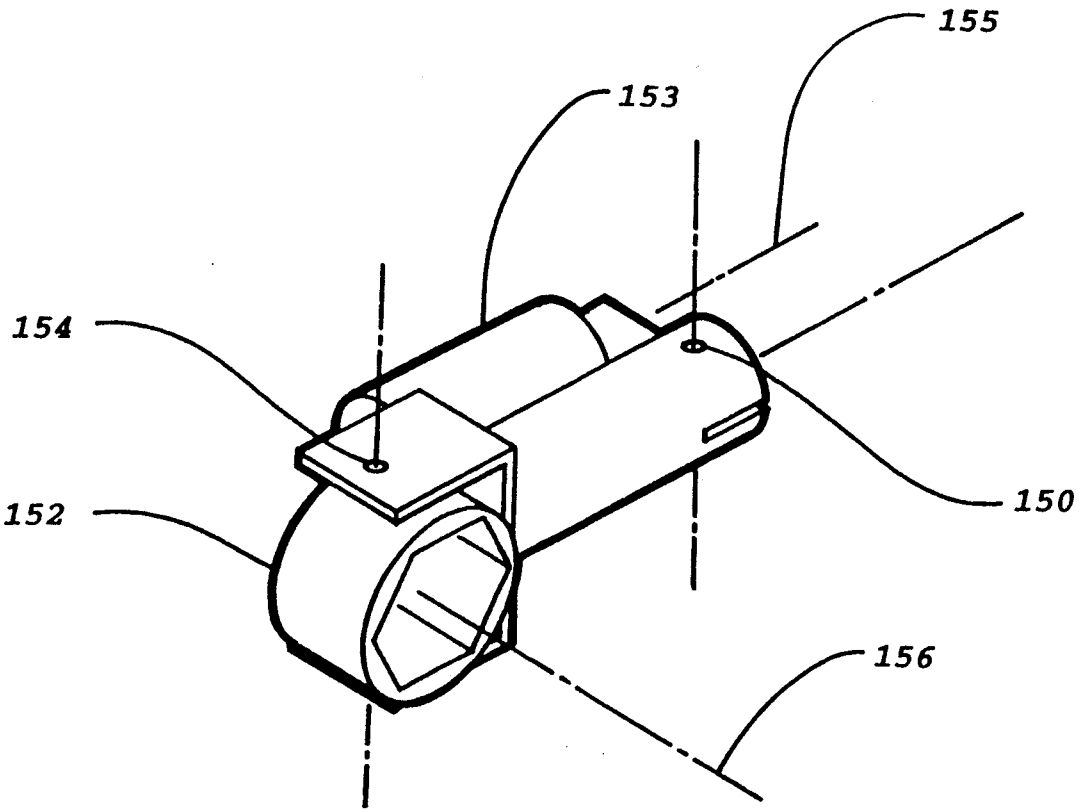
FIG. 15 is a perspective view of the tool shown in FIG. 13 in an alternate configuration adapted for storage.
Figure 16:
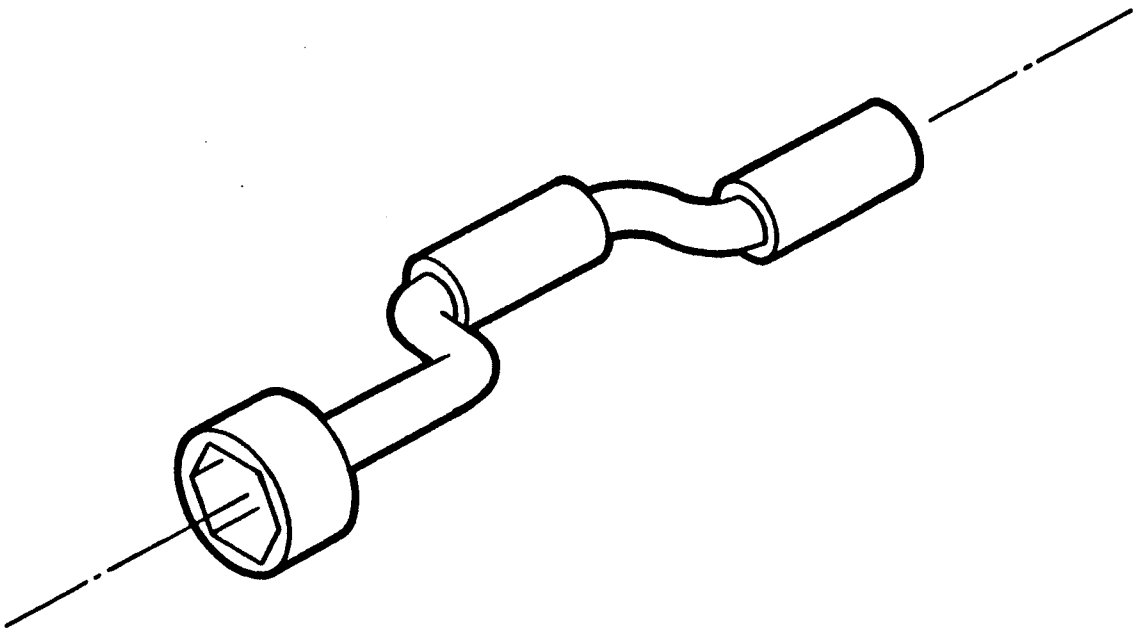
FIG. 16 depicts a tool of prior art.
Figure 17:
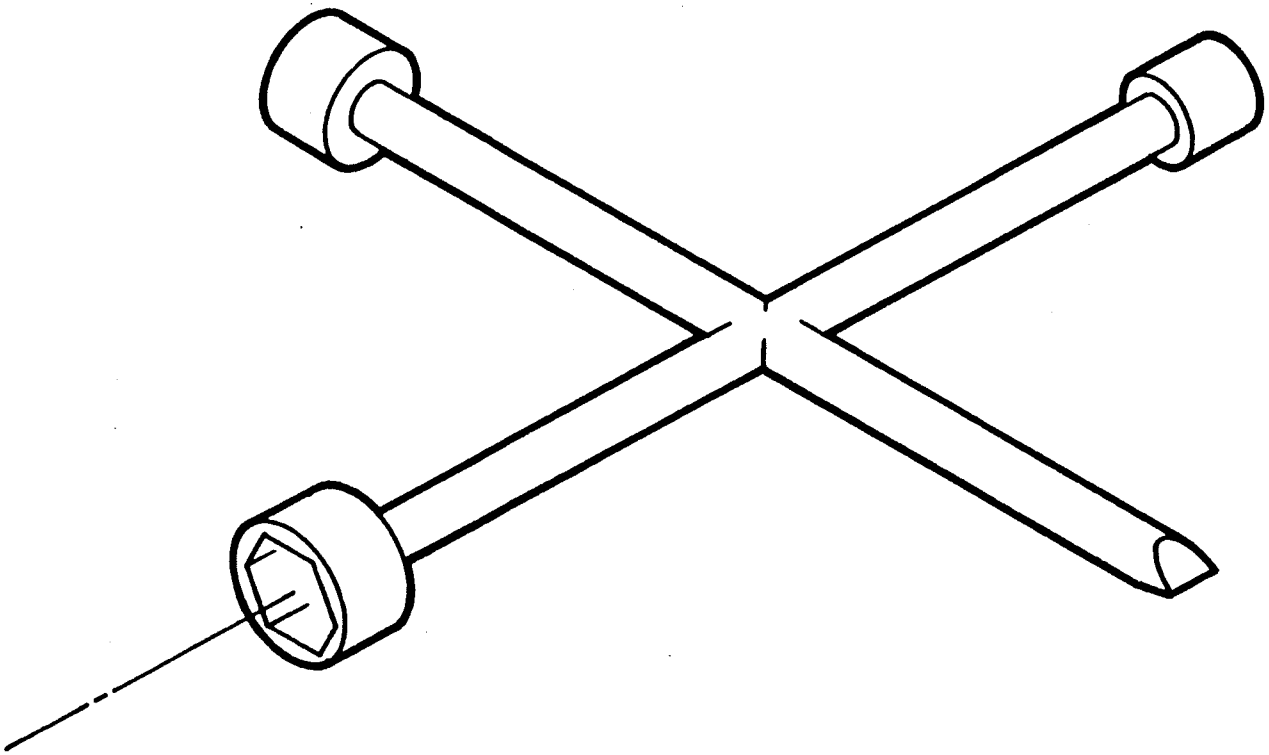
FIG. 17 depicts a tool of prior art.
Figure 18:
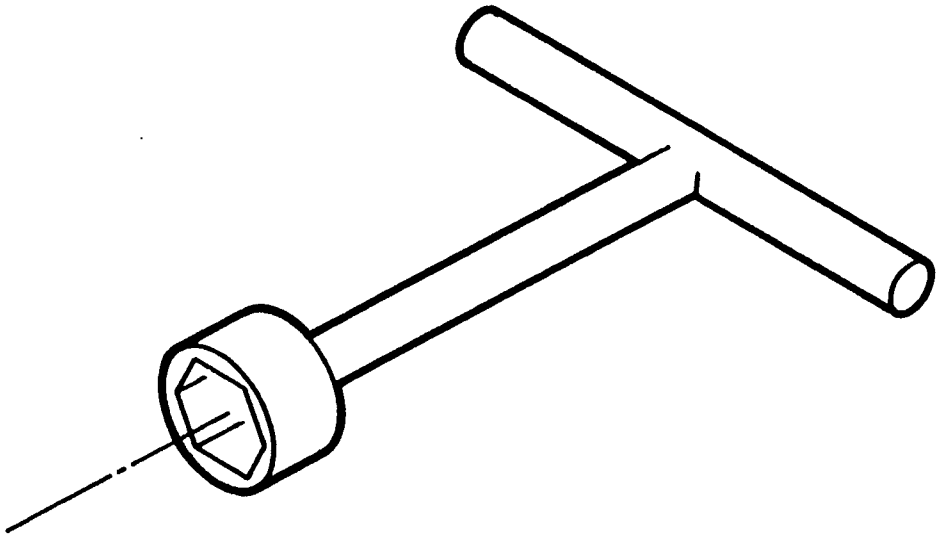
FIG. 18 depicts a tool of prior art.

FIGS. 13, 14, & 15 depict a fifth embodiment, similar to the embodiment of FIGS. 10, 11, & 12 wherein a second hinge (154) is located between the fitting (152) and first handle (151) in addition to the first hinge (150) which is located between the first (151) and second (153) handles.

During use in the configuration depicted in FIG. 13, the first (151) and second (153) handles are oriented perpendicularly to the axis (156) of the fitting (152) so as to provide the mechanical advantage required for high torque about said axis (156) by application of a tangential force to the second handle (153) about said axis (156).

During use in the configuration depicted in FIG. 14, with the first (151) and second (153) handles pivoted about the second hinge (154) so that the first handle (151) is coaxial with the fitting (152), said first handle (151) forms a rotational support for the tool. The centerline (155) of the second handle (153) is parallel with the axis (156) of the fitting (152), and separated by a certain fifth distance which is at least equal to the average width of the two handles (151 & 153), so that said second handle (153) can provide a mechanism by which the tool can be quickly rotated about said axis (156).

In FIG. 15, with the second handle (153) pivoted about the first hinge (150) one hundred and eighty angular degrees from the configuration of FIG. 14, a storage configuration is thereby Established in which the tool's total length is minimized to provide a shape more compact for reduced volume during storage. The fitting (152) may be pivoted about the second hinge (154) into whichever position provides the shortest overall length of the tool.

What I claim is:

1. A tool for attachment and removal of threaded components and comprising:

a coupling having a rotational axis;

arms means including a first handle portion having a first longitudinal axis; and a second handle portion displaced longitudinally from said first handle portion, and having a second longitudinal axis transversely displaced by a given distance from said first longitudinal axis and substantially parallel thereto;

an intermediary portion rigidly connecting an end of said first handle portion to an end of said second handle portion; and hinge means adjacent to said coupling and connecting said coupling to said first handle portion at an end opposite said intermediary portion and permitting relative movement therebetween about a pivot axis, said relative movement being at least ninety angular degrees and between a first condition wherein said arm means is disposed substantially transverse to said rotational axis and a second condition wherein one of said first or second logitudinal axes is substantially aligned with said rotational axis.

2. A tool according to claim 1 wherein said pivot axis is substantially perpendicular to said rotational axis.

3. A tool according to claim 2 wherein said second longitudinal axis is said one longitudinal axis.

4. A tool according to claim 2 wherein said pivot axis is displaced from said rotational axis by substantially said given distance.

5. A tool for attachment and removal of threaded components and comprising:

a coupling having a rotational axis and a pivot axis;

arm means including a hinge portion aligned with said pivot axis of said coupling to form a hinge means therewith; said arm means including a first handle portion displaced transversely from said rotational axis by a given distance and having a longitudinal axis laying on a plane parallel thereto; a second handle portion having a second longitudinal axis parallel to and displaced transversely from said first longitudinal axis and coplanar with said rotational axis; and an intermediary portion rigidly connecting said first handle portion and said second handle portion; and wherein said hinge means permits relative movement between the arm means and the coupling about said pivot axis such that the second longitudinal axis may be rotated from a first position coaxial with the rotational axis of the coupling adjacent to one end thereof, to a second position coaxial with said rotational axis and one hundred and eighty angular degrees from said first position.

6. A tool according to claim 5 wherein said pivot axis is substantially coplanar with said first and second longitudinal axes.

7. A tool according to claim 5 wherein said pivot axis is normal to a plane retaining one of said longitudinal axes.

* * * * *

US005279189C1

(12) EX PARTE REEXAMINATION CERTIFICATE (4930th)

United States Patent

Marino

(10) Number: US 5,279,189 C1

(45) Certificate Issued: Apr. 27, 2004

(54) TOOL FOR THE APPLICATION OF THREADED FASTENERS

(75) Inventor: Frank Marino, 394 Meredith Neck Rd., Meredith, NH (US) 03253

(73) Assignee: Frank Marino, Meredith, NH (US)

Reexamination Request:
No. 90/006,343, Jul. 30, 2002

Reexamination Certificate for:

| | |
|---|---|
| Patent No.: | **5,279,189** |
| Issued: | **Jan. 18, 1994** |
| Appl. No.: | **08/011,772** |
| Filed: | **Feb. 1, 1993** |

(51) Int. Cl.[7] ..... B25B 23/16; B25G 1/04

(52) U.S. Cl. ..... 81/177.8; 81/177.2; 81/177.6; 81/177.7

(58) Field of Search ..... 81/177.1, 177.2, 81/177.7, 177.8, 177.9, 489, 28, 35, 37

(56) References Cited

U.S. PATENT DOCUMENTS

| | | | |
|---|---|---|---|
| 1,430,574 | A | 10/1922 | Lueck |
| 3,348,436 | A | 10/1967 | Robinson |
| 3,383,962 | A | 5/1968 | Harris |

*Primary Examiner*—James G. Smith

(57) ABSTRACT

A tool for attachment and removal of threaded components including a coupling adapted to engage the component and an arm having a first handle and a second handle displaced longitudinally by a given distance and including at least one hinge connecting the coupling to the arm or connecting the first handle to the second handle and permitting relative movement therebetween about a pivot axis substantially normal to a plane retaining the rotational axis of the coupling.

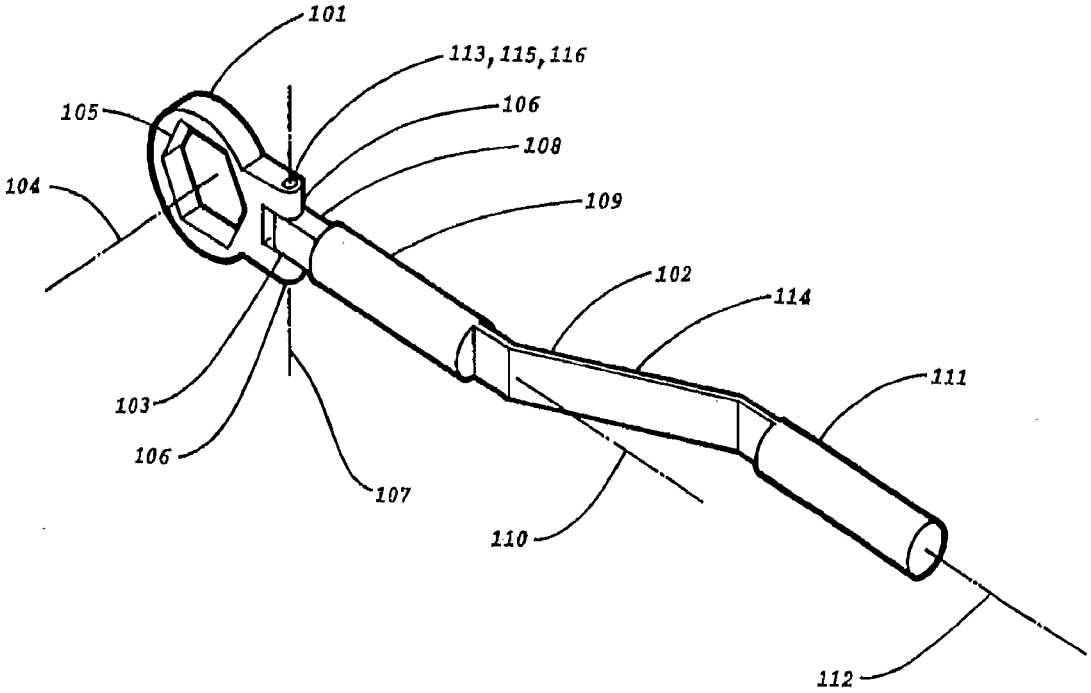

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 12–20:

It is common in the attachment of such threaded fasteners that the fastener must first be fitted to a structure with *a* mating thread, then rotated without subtantial torque until the fastener and structure are substantially, but not fully attached, then further rotated with a much higher degree of torque until the fastener is fully attached to the structure. A reversal of this procedure would be followed for removal of such a fastener from such a structure.

Column 1, lines 64–68 through column 2, lines 1–14:

In U.S. Pat. No. 4,334,445, [t]*T*imewell discloses a tool which includes a fitting and a single handle, connected to an intermediary member by two hinges. This tool is claimed to be adaptable into positions which allow both high torque operation, and high speed operation. However, this invention lacks a means to support the tool with hands at two separate locations, rendering the tool difficult and awkward to operate during some applications in the high speed condition, for instance those applications where the fitting cannot firmly engage the fastener such as the way a slotted screwdriver engages a slotted screw. Also, due to the amorphous relationship between the fitting and the handle of this tool caused by the use and location of the two hinges, it is not practical to use this tool in the high speed condition for applications where, in addition to the usual tangential force, the fitting must engage[d] the fastener with also an axial force, such as the way a screwdriver engages a mating screw.

Column 2, lines 38–40:

FIG. 1 is a perspective view of a [the] first embodiment of the invention in a configuration adapted for low speed/high torque applications.

Column 2, lines 41–43:

FIG. 2 is a perspective view of the tool shown in FIG. 1 in an alternate configuration adapted for high speed/low torque application*s*.

Column 2, lines 53–55:

FIG. 7 is a perspective view of the second embodiment of the invention in a configuration adapted for low speed/high torque application*s*.

Column 2, lines 56–58:

FIG. 8 is a perspective view of the tool shown in FIG. 7 in an alternate configuration adapted for high speed/low torque application*s*.

Column 2, lines 59–64:

FIG. 9 is a perspective view of the third embodiment of the invention in a configuration adapted for low speed/high torque application*s* with two other configurations, namely the high speed/low torque configuration and a storage configuration shown in phantom lines.

Column 2, lines 65–67:

FIG. 10 is a perspective view of the fourth embodiment of the invention in a configuration adapted for low speed/high torque application*s*.

Column 3, lines 1–3:

FIG. 11 is a perspective view of the tool shown in FIG. 10 in an alternate configuration adapted for high speed/low torque application*s*.

Column 3, lines 7–9:

FIG. 13 is a perspective view of the fifth embodiment of the invention in a configuration adapted for low speed/high torque application*s*.

Column 3, lines 10–12:

FIG. 14 is a perspective view of the tool shown in FIG. 13 in an alternate configuration adapted for high speed/low torque application*s*.

Column 6, lines 43–51:

In FIG. 15, with the second handle (153) pivoted about the first hinge (150) one hundred and eighty angular degrees from the configuration of FIG. 14, a storage configuration is thereby [E]*e*stablished in which the tool's total length is minimized to provide a shape more compact for reduced volume during storage. The fitting (152) may be pivoted about the second hinge (154) into whichever position provides the shortest overall length of the tool.

AS A RESULT OF REEXAMINATION, IT HAS BEEN DETERMINED THAT:

The patentability of claim 5 is confirmed.

Claims 1, 4, 6 and 7 are determined to be patentable as amended.

Claims 2 and 3, dependent on an amended claim, are determined to be patentable.

New claims 8–33 are added and determined to be patentable.

1. A tool for attachment and removal of threaded components and comprising:

a coupling having a rotational axis;

arm[s] means including a first handle portion having a first longitudinal axis; and a second handle portion displaced longitudinally from said first handle portion, and having a second longitudinal axis transversely displaced by a given distance from said first longitudinal axis and substantially parallel thereto;

an intermediary portion rigidily connecting an end of said first handle portion to an end of said second handle portion; and hinge means adjacent to said coupling and connecting said coupling to said first handle portion at an end opposite said intermediary portion and permitting relative movement therebetween about a pivot axis *displaced from and not intersecting said rotational axis,* said relative movement being at least ninety angular degrees and between a first condition wherein said arm means is disposed substantially transverse to said rotational axis and a second condition wherein one of said first or second longitudinal axes is substantially aligned with said rotational axis.

4. A tool [according to claim 2 wherein] *for attachment and removal of threaded components and comprising:*

*a coupling having a rotational axis;*

*arm means including a first handle portion having a first longitudinal axis; and a second handle portion displaced longitudinally from said first handle portion, and having a second longitudinal axis transversely displaced by a given distance from said first longitudinal axis and substantially parallel thereto;*

*an intermediary portion rigidly connecting an end of said first handle portion to an end of said second handle portion; and*

*hinge means adjacent to said coupling and connecting said coupling to said first handle portion at an end opposite said intermediary portion and permitting relative movement therebetween about a pivot axis being substantially perpendicular to said rotational axis and* said pivot axis is displaced from said rotational axis by substantially said given distance*, said relative movement being at least ninety angular degrees and between a first condition wherein said arm means is disposed substantially transverse to said rotational axis and a second condition wherein one of said first or second longitudinal axes is substantially aligned with said rotational axis.*

6. [A] *The* tool according to claim 5 wherein said pivot axis is substantially coplanar with said first [and second] longitudinal [axes] *axis.*

7. [A] *The* tool according to claim 5 wherein said pivot axis is normal to a plane [retaining] *containing* one of said longitudinal axes.

*8. The tool according to claim 1 wherein said coupling comprises a ratchet head having a square shaped drive member.*

*9. The tool according to claim 1 wherein said coupling comprises a ratchet head.*

*10. The tool according to claim 1 wherein said hinge means is formed by a pair of first extensions on said coupling, and a second extension on said arm means, each of said extensions having a hole therethrough, and a cylindrical pin extending through each of said holes.*

*11. The tool according to claim 1, wherein said pivot axis is displaced from said rotational axis by substantially said given distance.*

*12. The tool according to claim 1 further comprising an extension protruding from said first handle portion, said extension collinear with said first longitudinal axis.*

*13. The tool of claim 12 wherein the extension protruding from said first handle portion is at an end opposite the intermediary portion.*

*14. The tool according to claim 4 wherein said second longitudinal axis is said one longitudinal axis.*

*15. The tool according to claim 4 wherein said pivot axis is substantially coplanar with said first longitudinal axis.*

*16. The tool according to claim 4 wherein said pivot axis is normal to a plane containing one of said longitudinal axes.*

*17. The tool according to claim 4 wherein said coupling comprises a ratchet head having a square shaped drive member.*

*18. The tool according to claim 4 wherein said hinge means is formed by a pair of first extensions on said coupling, and a second extension on said arm means, each of said extensions having a hole therethrough, and a cylindrical pin extending through each of said holes.*

*19. The tool according to claim 4 further comprising an extension protruding from said first handle portion, said extension collinear with said first longitudinal axis.*

*20. The tool according to claim 19 wherein the extension protruding from said first handle portion is at an end opposite the intermediary portion.*

*21. A tool for attachment and removal of threaded components and comprising:*

*a coupling having a rotational axis;*

*arm means including a first handle portion having a first longitudinal axis; and a second handle portion displaced longitudinally from said first handle portion, and having a second longitudinal axis transversely displaced by a given distance from said first longitudinal axis and substantially parallel thereto;*

*an intermediary portion rigidly connecting an end of said first handle portion to an end of said second handle portion;*

*an extension protruding from said first handle portion at an end opposite said intermediary poprtion and said extension collinear with said first longitudinal axis; and*

*a hinge means adjacent to said coupling and connecting said coupling to said extension and said hinge means permitting relative movement therebetween about a pivot axis, said relative movement being at least ninety angular degrees and between a first condition wherein said arm means is disposed substantially transverse to said rotational axis and a second condition wherein one of said first or second longitudinal axes is substantially aligned with said rotational axis.*

*22. The tool according to claim 21 wherein said coupling comprises a ratchet head having a square shaped drive member.*

*23. The tool according to claim 21 wherein said hinge means is formed by a pair of first extensions on said coupling, and a second extension on said arm means, each of said extensions having a hole therethrough, and a cylindrical pin extending through each of said holes.*

*24. The tool according to claim 21 wherein said pivot axis is substantially perpendicular to said rotational axis.*

*25. The tool according to claim 21 wherein said pivot axis is substantially perpendicular to said first longitudinal axis.*

*26. The tool according to claim 21 wherein said second longitudinal axis is said one longitudinal axis.*

*27. The tool according to claim 21 wherein said pivot axis is displaced from said rotational axis by substantially said given distance.*

*28. The tool according to claim 21 wherein said pivot axis is substantially coplanar with said first longitudinal axis.*

*29. The tool according to claim 21 wherein said pivot axis is normal to a plane containing one of said longitudinal axes.*

*30. A tool for attachment and removal of threaded components and comprising:*

*a coupling having a rotational axis;*

*arm means including first and second handle portions, an intermediary portion rigidly connecting and end of said first handle portion to an end of said second handle portion, said second handle portion being displaced longitudinally from said first handle portion; said first and second handle portions respectively having first and second longitudinal axes that are transversely displaced by a given distance and substantially parallel; and*

*hinge means adjacent to said coupling and connecting said coupling to said first handle portion at an end opposite said intermediary portion for permitting relative movement therebetween about a pivot axis displaced from said rotational axis by substantially said given distance, said relative movement being at least ninety angular degrees and between a first condition wherein said arm means is disposed substantially transverse to said rotational axis and a second condition wherein one of said first or second longitudinal axes is substantially aligned with said rotational axis.*

*31. The tool according to claim 30 wherein said coupling comprises a ratchet head having a square shaped drive member.*

*32. The tool according to claim 30 wherein said coupling comprises a ratchet head.*

*33. The tool according to claim 30 wherein said hinge means is formed by a pair of first extensions on said coupling and a second extension on said arm means, each of said extensions having a hole therethrough and a cylindrical pin inserted through each of said holes.*

* * * * *